US005234395A

United States Patent [19]

Miller et al.

[11] Patent Number: 5,234,395

[45] Date of Patent: Aug. 10, 1993

[54] ADJUSTABLE ASYMMETRIC-RESISTANCE UPPER BODY EXERCISER

[76] Inventors: Jack V. Miller, 700 N. Auburn Ave., Sierra Madre, Calif. 91024; Dennis J. Colonello, 10230 Valleyheart Dr. #103, Studio City, Calif. 91604

[21] Appl. No.: 828,494

[22] Filed: Jan. 30, 1992

[51] Int. Cl.[5] ..... A63B 21/018

[52] U.S. Cl. ..... 482/118; 482/114; 482/120; 482/139

[58] Field of Search ..... 482/114, 115, 118, 119, 482/120, 139, 131, 82

[56] References Cited

U.S. PATENT DOCUMENTS

| | | | |
|---|---|---|---|
| 4,293,125 | 10/1981 | Hinds | 482/82 |
| 4,335,875 | 6/1982 | Elkin | 482/131 |
| 4,375,886 | 3/1983 | Muys | 482/82 |
| 4,441,707 | 4/1984 | Bosch | 482/139 |
| 4,540,173 | 9/1985 | Hopkins, Jr. | 482/139 |

*Primary Examiner*—Richard J. Apley

*Assistant Examiner*—Lynne A. Reichard

*Attorney, Agent, or Firm*—Small Larkin Kidde & Golant

[57] ABSTRACT

An adjustable resistance upper body exerciser includes a generally arcuate belt (2) encircling the waist of a user and having a generally flat, rigid posterior central portion 3 and flexible anterior portions (4, 4*a*) including buckling means (5). A flexible inelastic cord (7) having a length and left and right ends (8, 8*a*) passes through an elongated guide means (12) attached to the belt, slidably retaining a central portion of the length the cord and leaving the right and left ends of the cord extending in the anterior direction. A snubber (15) is attached to the rigid posterior portion of the belt, contacting the slidable cord and applying an adjustable friction load to the slidably retained cord. A pair of handles (18, 18*a*) are attached to left and right ends of the cord, whereby a user wearing the belt encircling the waist may alternately pull said left and right handles with a tension force generally proportional to the friction load applied to the cord by the snubber.

8 Claims, 2 Drawing Sheets

ADJUSTABLE ASYMMETRIC-RESISTANCE UPPER BODY EXERCISER

BACKGROUND OF THE INVENTION

This invention applies to the field of exercisers, and in particular to upper body exercisers that encircle the body of the user.

The need for upper body exercise is well known, and many devices for performing upper body exercise while walking, jogging or running are in the prior art. However, such prior art devices have not met the continuing need for an upper body exerciser that is simple, light-weight and unobtrusive enough to be publicly worn and used without discomfort or embarrassment. A walker or jogger does not want to carry along a cumbersome machine that looks like corrective orthopedic apparatus.

There are two basic forms of exercise apparatus: Isotonic resistance exercisers and isometric exercisers. Isotonic exercisers provide an adjustable resistance whereby the user's effort is balanced by the resistance of the exerciser, which may be applied asymmetrically. Conversely, isometric exercisers use forces applied symmetrically by the user on opposite sides of the body, substantially without any resistance in the exerciser mechanism.

The principal advantage of adjustable resistance exercisers is that they are capable of exercising the muscle groups that cross the body asymmetrically to permit torsional exercise movements. Many activities, such as swinging a bat, tennis racquet or golf club; or walking, running, swimming, sawing, hammering, punching, chopping, etc. are all substantially torsional force activities. Therefore, in order to build or tone muscles for most normal activities it is necessary to apply asymmetric loads to the body. Since humans vary greatly in physical size and strength, an isotonic upper body resistance exerciser must also provide adjustment in both size and resistance to balance the forces for a variety of users.

It is also very desirable to perform upper body exercises while doing lower body exercises, such as walking, jogging or running. Therefore, an upper body resistance exerciser should be light-weight, simple, and unobvious on the body of the user who normally walks, jogs or runs in public.

One additional problem inherent in an upper body resistance exerciser worn on the body is the connection of the hands of the user to the tension apparatus. Pushing the hands outward from the body performs various upper body exercises, but that movement tends to pull tension cords, commonly made of elastic in prior art exercisers, across the wrists and forearms, causing abrasion and discomfort.

Prior art resistance exercisers that permit asymmetrical exercise, are quite cumbersome and complex, usually requiring some kind of harness to stabilize the exerciser against rotation on the torso under asymmetrical loads.

One example of a resistance exerciser for asymmetrical loads is U.S. Pat. No. 4,986,537 (D'Orta). This device eliminates the need for a tension cord, and thus solves the problem of wrist abrasion by the use of hand cranks which are individually and torsionally adjustable; and are attached to a harness encompassing both the waist and thighs of the exerciser. The principal disadvantage of this prior art is an extremely limited range and direction of motion. Also, the attachment of the crank mechanism frames to both the belt and the thigh straps would virtually preclude walking, jogging or running while performing upper body exercises.

Another example of a resistance exerciser for asymmetrical loads is U.S. Pat. No. 4,993,705 (Tolle) in which elastic bands are attached to a vest for torsional resistance to the exercise forces. This exerciser solves the wrist abrasion problem by passing the cords from a stirrup handle through guides on arm and wrist cuffs.

There are a number of isometric upper body exercisers that do not permit torsional resistance exercising, as one hand is always used to offset the load applied by the other hand. Thus these isometric exercisers can only exercise muscles in symmetrical balance.

One example of a prior art isometric upper body exerciser is U.S. Pat. No. 4,961,573 (Wehrell) is which an elastic tension cord is wound around a number of pulleys to provide a long length and uniform loading. However, being an isometric exerciser, the load on one hand of the user is always resisted isometrically by the other hand of the user. There is no means for applying an asymmetrical tension load against the handles. This severely limits this exerciser's ability to be used in asymmetrical or torsional exercises. Further, the stirrup handles pass the tensioned elastic cords across the users wrists and forearms, creating potential discomfort and abrasion. Since this invention is intended for boxers, it is probable that the inventor intended the device to be used while wearing gloves that protect the wrists. This type of exerciser is very bulky and complex and would not be obscure or sufficiently unobvious to be used by the average consumer while publicly walking or running.

An example of an extremely simply isometric exerciser is shown in U.S. Pat. No. 4,335,872 (Elkin) in which a rope passes though a padded tube that encircles behind the neck of the user. This is a simple, light-weight exerciser that would be relatively obscure in public use, but it is isometric. Since one hand must balance the force on the other hand, this upper body exerciser is incapable of asymmetrical or torsional exercises, as there is no means for applying an asymmetrical tension load against the handles.

Another example of a very simple isometric exerciser is shown in U.S. Pat. No. 4,441,707 (Bosch) in which a rope passes though a tube that encircles behind the back of the user. Also being isometric, one hand must balance the force on the other hand and therefore, this upper body exerciser is incapable of asymmetrical or torsional exercises. Further, the stirrup handles tend to pass the tension lines across the user's wrists and creating the potential for discomfort and abrasion. This exerciser meets the requirement of being small and obscure in use, permitting exercise in public while walking or running, but with no means for applying an asymmetrical tension load the efficacy of the exercises permitted is limited.

It is the principal purpose of the present invention to overcome the problems and shortcomings of the above prior art devices by producing an adjustable, isotonic, asymmetric-resistance upper body exerciser that does not require isometric force balance. It is a further purpose of the invention to provide an upper body exerciser that is easily adjusted in tension of the cords leading to the individual handles. It is yet another purpose of the present invention to provide an adjustable asymmetric-resistance upper body exerciser that has a means for resisting rotational motion around the users body without resorting to a complex harness. It is still another purpose of the present invention to provide an upper body exerciser that is simple, small, lightweight; and sufficiently obscure in use to permit public use while walking, jogging or running.

The achievement of the foregoing purposes of the invention are achieved by an adjustable resistance upper body exerciser which includes a generally arcuate belt encircling the waist of a user and has a rigid posterior central portion, generally conforming to the shape of the user's back to limit rotation on the body. The belt also has generally flexible anterior portions including a buckle to tighten the belt around the waist of the user. A flexible inelastic cord passes through an elongated guide attached to the belt that slidably retains a central portion of the length the cord, leaving the right and left ends of said cord extending in the anterior direction and terminating in adjustable-lengths in a pair of handles.

A friction snubber is attached to the rigid posterior portion of the belt, in contact with the slidable cord and applying an adjustable friction load to the cord. A user wearing the belt encircling the waist may alternately pull said left and right handles with a tension force generally proportional to the friction load applied to the cord by the snubber. The snubber includes a friction shoe applying a friction load to the cord which is in turn applied by an adjustable knob on a screw passing through the rigid posterior portion of the belt. This permits the user to turn the knob to adjust the friction load on the cord.

A preferred embodiment includes a means for adjusting the length the the cord by bending each cord tip into a bight, wherein the cord is inserted into the hole in the handle, passes around a plug inside the handle and end of the cord extends back through the hole in the handle, so the position of the handle on length of the cord may be adjusted.

DETAILED DESCRIPTION OF THE DRAWINGS

Figure 1:
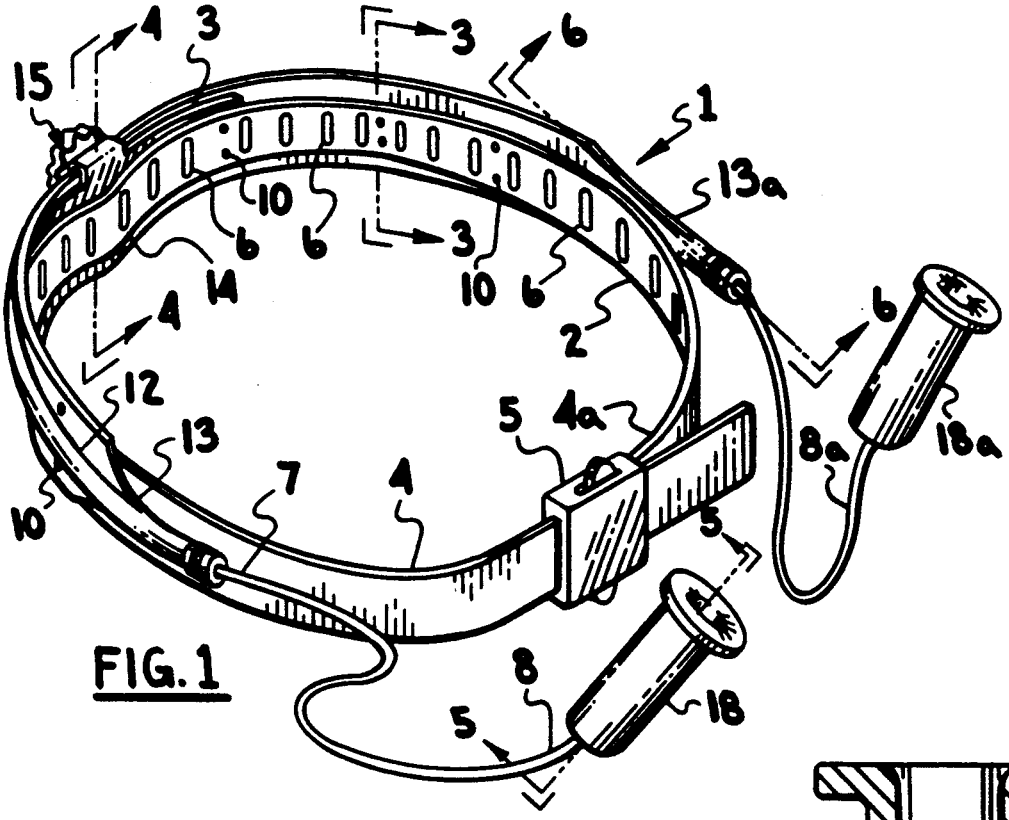
FIG. 1 is a perspective view of an adjustable asymmetric-resistance upper body exerciser according to the present invention.

In FIG. 1 an adjustable asymmetric-resistance upper body exerciser 1 according to the present invention is shown having a generally arcuate belt 2 encircling the waist of a user, said belt 2 having a generally rigid posterior central portion 3 and generally flexible anterior portions 4 and 4*a* including buckling means 5 and a pattern 6 of elastomeric high friction material to reduce rotational slippage on the body under torsional loads during asymmetrical exercise. A flexible inelastic cord 7 has a length and left and right ends 8 and 8*a*, respectively. An elongated guide means 12 is attached to belt 2 and has narrowed anterior ends 13 and 13*a*, respectively. Guide means 12 slidably retains a central portion of the length the cord 7, leaving the right and left ends 8 and 8*a*, respectively, of cord 7 extending in the anterior direction.

Figure 2:
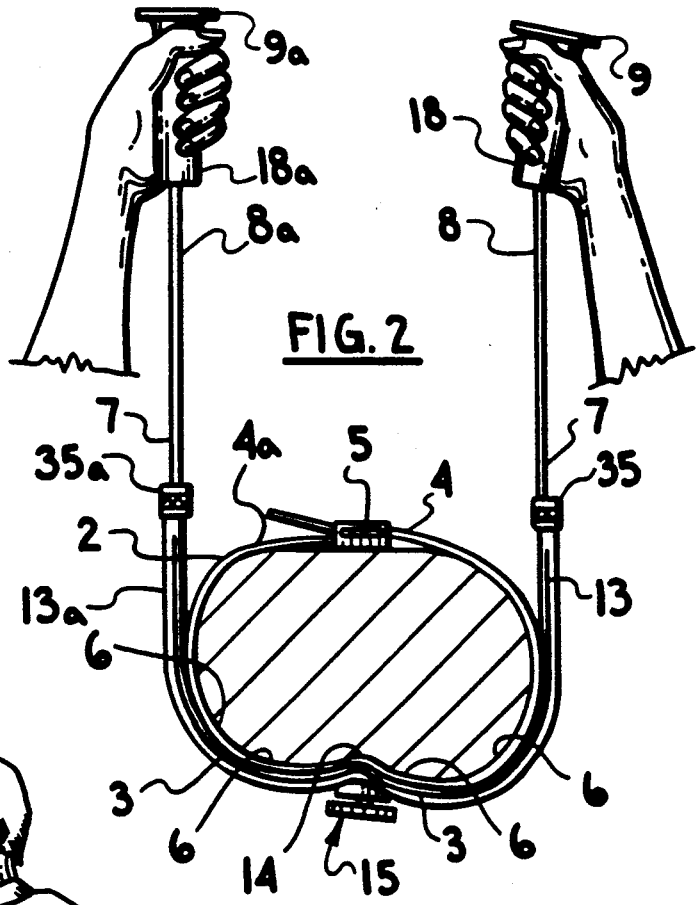
FIG. 2 is a cross-sectional plan view of the exerciser of FIG. 1, taken in a horizontal plane while in use.

As shown in both FIG. 1 and FIG. 2, a snubber 15 is attached to the rigid posterior portion 3 of belt 2. Right and left hand handles, 18 and 18*a*, respectively, are attached to left and right ends 8 and 8*a*, respectively, of the cord, whereby a user wearing the belt encircling the waist may alternately pull right and left hand handles 18 and 18*a*, respectively. The handles are provided with radial flanges 9 and 9*a*, respectively, to prevent the handles from inadvertently slipping out of the grip of the user. Rigid portion 3 of belt 2 has a substantially straight section including in a preferred embodiment a convex portion 14 that is positioned adjacent the spine of the user, against the posterior lumbo-dorsal fascia and the latissumus dorsi muscles.

Figure 3:
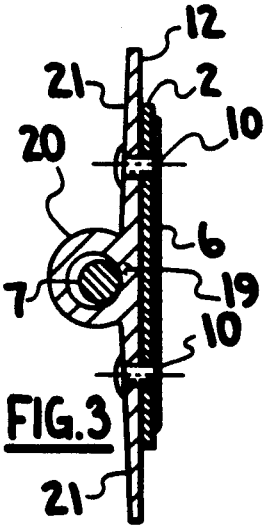
FIG. 3 is a transverse cross-sectional view of the exerciser of FIG. 1, taken along section line 3—3 of FIG. 1.

In FIG. 3 a cross section of the exerciser is shown having belt 2 attached with fasteners 18 to elongated guide means 12 for cord 7. Cord 7 is retained in guide means 12 by a tube 20 in which the cord is slidably disposed. Tube 20 has tangential flanges 21 whereby the cord is retained in the tube and the guide is attached to the belt with fasteners 10 through tangential flanges 21.

Figure 4:
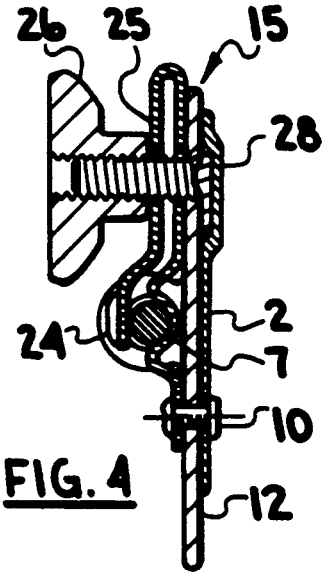
FIG. 4 is a transverse cross-sectional view of the exerciser of FIG. 1, taken along section line 4—4 of FIG. 1.

FIG. 4 is a cross-sectional view of snubber 15 which includes a metal shoe 24 contacting the slidable cord 7 and having a resilient support 25. A hand knob 26 on a screw 28 biases resilient support 25 and shoe 24 against cord 7. The amount of friction applied by shoe 24 to cord 7 is determined by manual rotation of knob 26 on the shaft of screw 28 applying an adjustable friction load to the slidably retained cord 7. Tension resistance of the handles and cord may thus may be varied by the user, proportional to the friction load applied to the cord by the snubber as the user rotates hand knob 26.

Figure 5:
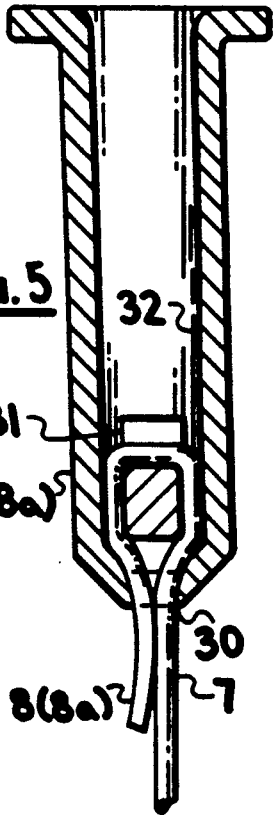
FIG. 5 is a transverse cross-sectional view of the exerciser of FIG. 1, taken along section line 5—5 of FIG. 1.

In FIG. 5 a cross-sectional view of a handle 18, 18*a* is shown in which an enlarged end 8, 8*a* of cord 7 is a bight, wherein end 8, 8*a* of cord 7 is inserted into the hole 30 in the handle, passes around a plug 31 in a hole 32 the handle and end 8, 8*a* of the cord extends back through hole 30 in handle 18 (18*a*) forming two cord portions therethrough. Adjustment of the cord length may be made at either handle by pushing one of the two cord portions passing through the hole in the handle and the pulling the other cord portion out of the hole in the handle.

Figure 6:
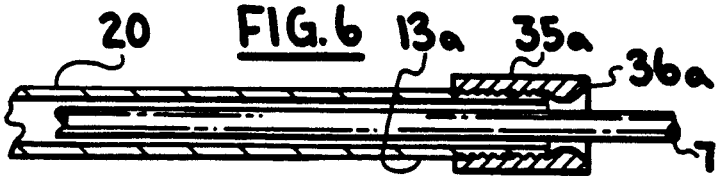
FIG. 6 is a transverse cross-sectional view of the exerciser of FIG. 1, taken along section line 6—6 of FIG. 1.

In FIG. 6 one of the anterior ends 13, 13*a* of tube 20 is shown terminating at either end 13, 13*a* in a cylindrical bushing 35, 35*a* having a smoothly contoured hole 36*a* to preclude excess wear of tube 20 during use.

Figure 7:
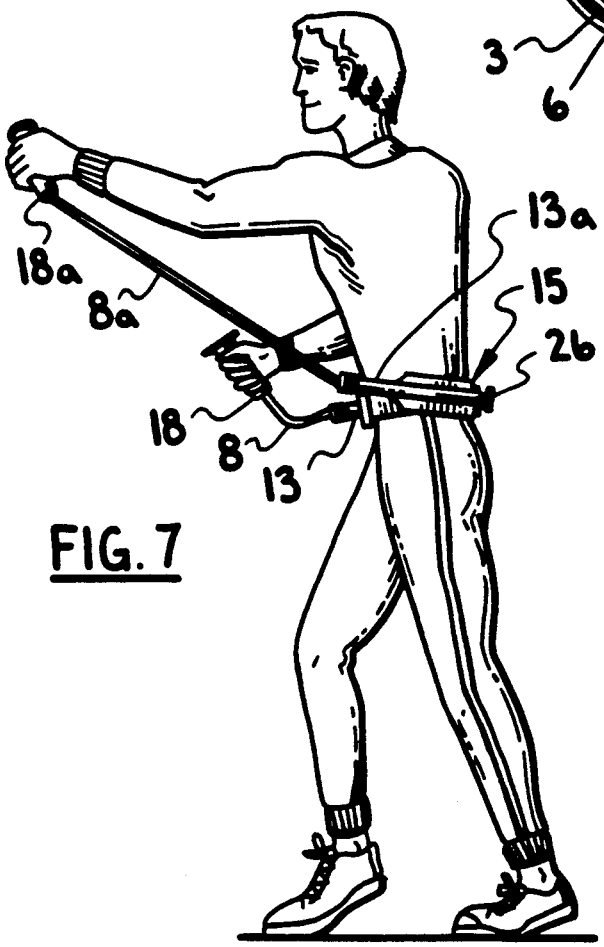
FIG. 7 is a side elevational view of the exerciser of FIG. 1, shown during asymmetrical tension exercise by a user.

In FIG. 7 a user is shown exercising the upper body while walking or jogging by pulling alternate handles 18, 18*a* and ends 8, 18*a* of cord 7 which is adjustable in tension by rotation of knob 26 of snubber 15. In this manner exercise at any desired tension level desired may be accomplished to perform asymmetrical upper body exercise while also performing lower body exercises, such as walking, jogging or running. Due to the ability of snubber 15 to apply cord tension on the cord as one handle is extended, there is no need to maintain any tension by the opposite handle, as indicated by the slack cord end 8. The single-ended handles 18, 18*a* keep the cord ends 8, 8*a* well clear of the user's wrists and forearms, thus avoiding discomfort and abrasion.

We claim:

1. An adjustable asymmetric-resistance upper body exerciser including:

a generally arcuate belt encircling the waist of a user, said belt having a generally rigid transversely elongated posterior central portion and generally flexible anterior portions including buckling means:

a flexible inelastic cord having a length and left and right ends;

an elongated guide means attached to the belt, said guide means slidably retaining a central portion of the length of the cord, leaving the right and left ends of said cord extending in the anterior direction therefrom;

a snubber attached to the rigid posterior portion of the belt, said snubber contacting the slidable cord and applying an adjustable friction load to the slidably retained cord;

said rigid transversely elongated posterior portion of the generally arcuate belt having a centrally located non-arcuate section in which the snubber is mounted and has an anterior-facing inward-projecting portion adjacent the spine, against the lumbo-dorsal fascia and latissimus dorsi muscles of the user; and handles attached to left and right ends of the cord, whereby a user wearing the belt encircling the waist may alternately pull said left and right handles with a tension force generally proportional to the friction load applied to the cord by the snubber.

2. An adjustable asymmetric-resistance upper body exerciser including:

a generally arcuate belt encircling the waist of a user, said belt having a generally rigid transversely elongated posterior central portion and generally flexible anterior portions including buckling means;

a flexible inelastic cord having a length and left and right ends;

an elongated guide means attached to the belt, said guide means slidably retaining a central portion of the length of the cord, leaving the right and left ends of said cord extending in the anterior direction therefrom;

a snubber attached to the rigid posterior portion of the belt, said snubber having a friction shoe in contact with the slidable cord, said friction shoe applying a friction load to the cord which is in turn applied by an adjustable knob on a screw passing through the rigid posterior portions of the belt; and handles attached to left and right ends of the cord, whereby a user wearing the belt encircling the waist may alternately pull said left and right handles with a tension force generally proportional to the friction load applied to the cord by the snubber.

3. An adjustable asymmetric-resistance upper body exerciser including:

a generally arcuate belt encircling the waist of a user, said belt having a generally rigid transversely elongated posterior central portion and generally flexible anterior portions including buckling means;

a flexible inelastic cord having a length and left and right ends;

an elongated guide means attached to the belt, said guide means slidably retaining a central portion of the length of the cord, leaving the right and left ends of said cord extending in the anterior direction therefrom;

a snubber attached to the rigid posterior portion of the belt, said snubber contacting the slidable cord and applying an adjustable friction load to the slidably retained cord;

handles attached to left and right ends of the cord, each handle comprising an elongated cylindrical tube having a closed end and a radially flanged open end at least 50% larger than the tube in which the cord passes through a hold in the closed end of said tube and is retained therein by an enlarged cord tip;

the enlarged cord tip is a bight, wherein the cord is inserted into the hole in the handle, passes transversely around a plug inside the handle and the ends of the cord extends back through the same hole in the handle, forming two frictionally-contacting cord portions therethrough; and whereby a user wearing the belt encircling the waist may alternately pull said left and right handles with a tension force generally proportional to the friction load applied to the cord by the snubber.

4. An exerciser according to claim 3 in which one of the two cord portions passing through the hole in the handle may be pushed into the hole in the handle and the other cord portion may be pulled out of the same hole in the handle, whereby the position of the handle on length of the cord may be adjusted.

5. An adjustable asymmetric-resistance upper body exerciser including:

a generally arcuate belt encircling the waist of a user, said belt having a generally rigid transversely elongated posterior central portion and generally flexible anterior portions including buckling means;

a flexible inelastic cord having a length and left and right ends;

an elongated guide means attached to the belt, said guide means includes a tube in which the cord is slidably disposed, and slidably retains a central portion of the length of the cord, leaving the right and left ends of said cord extending in the anterior direction therefrom;

said tube having tangential flanges whereby the cord is retained in the tube and the guide is attached to the belt with fasteners through the tangential flanges;

a snubber attached to the rigid posterior portion of the belt, said snubber contacting the slidable cord and applying an adjustable friction load to the slidably retained cord; and handles attached to left and right ends of the cord, whereby a user wearing the belt encircling the waist may alternately pull said left and right handles with a tension force generally proportional to the friction load applied to the cord by the snubber.

6. An a exerciser according to claim 5 in which the anterior ends of the elongated guide terminate in cylindrical bushings.

7. An adjustable asymmetric-resistance upper body exerciser including:

a generally arcuate belt encircling the waist of a user, said belt having a generally rigid transversely-elongated posterior central portion and generally flexible anterior portions including buckling means, said belt also having an inward-facing surface provided with a layer of friction-increasing material;

a flexible inelastic cord having a length and left an right ends;

an elongated guide means attached to the belt, said guide means slidably retaining a central portion of the length the cord, leaving the right and left ends of said cord extending in the anterior direction therefrom;

a snubber attached to the rigid transversely-elongated posterior portion of the belt, said snubber contacting the slidable cord and applying an adjustable friction load to the slidably retained cord; and handles attached to left and right ends of the cord, whereby a user wearing the belt encircling the waist may alternately pull said left and right handles with a tension force generally proportional to the friction load applied to the cord by the snubber.

8. An a exerciser according to claim 1 in which the layer of friction-increasing material is a printed pattern of elastomeric rubber-like plastic.

* * * * *